US005473922A

United States Patent [19]

Bair et al.

[11] Patent Number: 5,473,922

[45] Date of Patent: Dec. 12, 1995

[54] MOTORIZED ELECTRONIC LOCK

[75] Inventors: David R. Bair; Hamid S. Abroy; Roy T. Abner, all of Lexington, Ky.

[73] Assignee: Sargent & Greenleaf, Inc., Nicholasville, Ky.

[21] Appl. No.: 165,630

[22] Filed: Dec. 13, 1993

[51] Int. Cl.[6] ..... E05B 47/02

[52] U.S. Cl. ..... 70/416; 70/333 R; 70/280; 292/144

[58] Field of Search ..... 70/277, 278, 279, 70/280, 416, 333 R; 292/144, DIG. 62

[56] References Cited

U.S. PATENT DOCUMENTS

| | | | |
|---|---|---|---|
| 4,364,249 | 12/1982 | Kleefeldt | 292/DIG. 23 |
| 4,633,688 | 1/1987 | Beudat et al. | 70/280 |
| 4,800,741 | 1/1989 | Kerschenbaum et al. | 70/279 |
| 4,833,465 | 5/1989 | Abend et al. | 70/279 |
| 4,893,704 | 1/1990 | Fry et al. | 292/DIG. 62 |
| 4,926,664 | 5/1990 | Gartner et al. | 70/278 |
| 5,033,282 | 7/1991 | Gartner et al. | 70/278 |
| 5,078,436 | 1/1992 | Kleefeldt et al. | 292/216 |
| 5,246,258 | 9/1993 | Kerschenbaum et al. | 70/279 |

FOREIGN PATENT DOCUMENTS

| | | | |
|---|---|---|---|
| 0267423 | 5/1988 | European Pat. Off. | 70/276 |

*Primary Examiner*—Darnell M. Boucher
*Attorney, Agent, or Firm*—Popham, Haik, Schnobrich & Kaufman, Ltd.

[57] ABSTRACT

A motorized electronic lock is disclosed including an electric motor, a screw powered by the motor, a nut threadedly engaged with the screw and having two extending arms projecting therefrom, one of which arms is a cam follower arm that rides along a cam surface on a cam bracket, and the other of which is a locking arm that is engageable with a slot in a bolt in order to provide a dead-bolting feature for the bolt, and a relocking spring which is either held out of the way of the bolt by a downwardly extending leg of the cam bracket or is biased to a position behind the bolt, blocking the bolt from being able to retract.

11 Claims, 4 Drawing Sheets

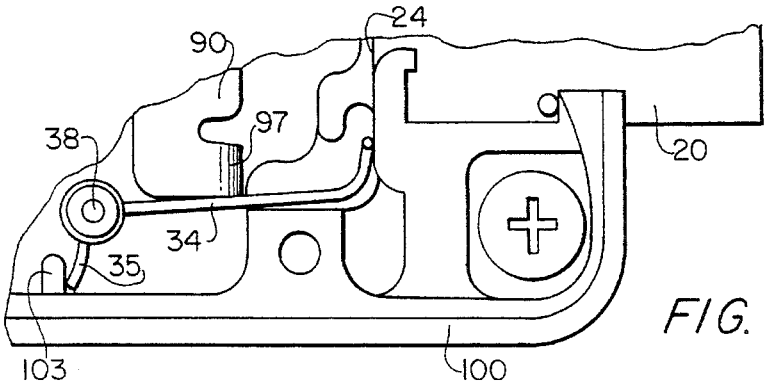
FIG. 6
FIG. 7
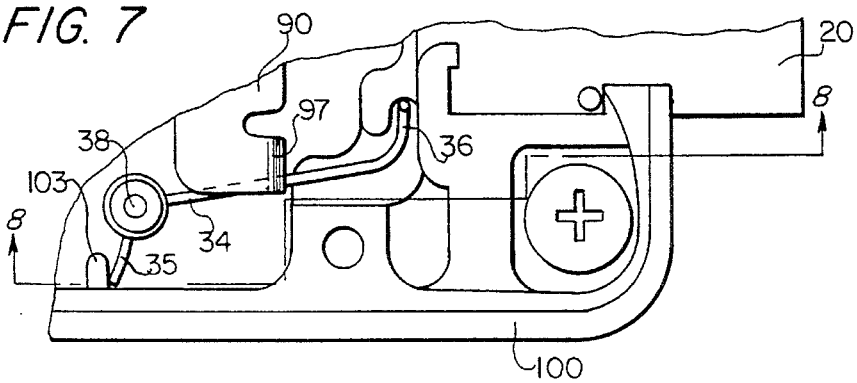
FIG. 8
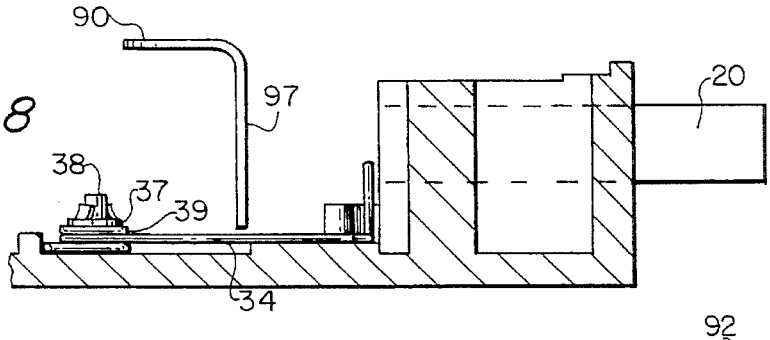
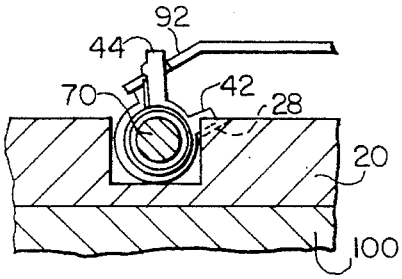
FIG. 9
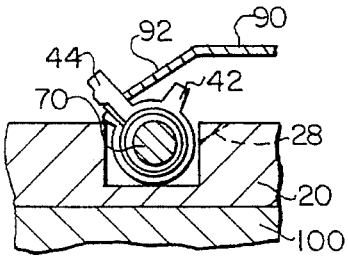
FIG. 10
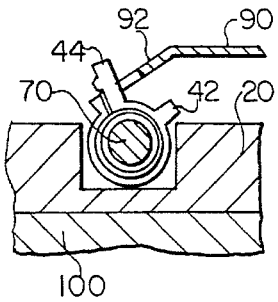
FIG. 11

MOTORIZED ELECTRONIC LOCK

BACKGROUND OF THE INVENTION

1. Field of the Invention

The present invention relates to electrically operated locks for security doors, and more particularly to an automatically self locking electronic lock system for use with a safe or any other type security door.

2. Related Art

U.S. Pat. Nos. 4,926,664 and 5,033,282 show self locking electronic locks for use with safe doors wherein the associated locking mechanisms are automatically self locking. In the locking mechanisms of these prior patents, a lock bolt is normally biased into a locking position, and electronically driven means are provided for effecting unlocking by withdrawing the lock bolt against its bias from a locking engagement with bolt works. The prior patents show a lost motion connection being provided between the lock bolt and the electrically driven means whereby after opening of the safe door, the electrically driven means can be reversed, through the lost motion connection with the lock bolt, to release the lock bolt which is then free to return to its normally biased locking position.

In addition, the prior patents include blocking means separate from the connecting means between the lock bolt and the electrically driven means. The blocking means prevents unauthorized withdrawal of the lock bolt from its normally biased position, and consists of a leaf spring having a stop surface to contact and block withdrawal of the bolt. An engagement surface integral to the leaf spring engages the lost motion connection and deflects the leaf spring away from a position blocking the lock bolt upon operation of the lost motion connection in order to enable retraction of the lock bolt. Providing the blocking means as separate means from the connecting means increases the complexity of the prior art locks.

Electronic code input means are also well known in the art of electronic locks as in part disclosed in prior patents, U.S. Pat. Nos. 4,745,784, and 4,148,092, the disclosures of which are incorporated herein by this reference.

SUMMARY OF THE INVENTION

In view of the foregoing, it is a primary object of the present invention to disclose and provide an automatically self locking electronic lock for safe doors wherein a dead-bolting feature is provided by the same components used in the connection between a lock bolt and the electrically driven means.

According to a preferred embodiment of the present invention, a motorized electronic lock is provided having a lock housing, a reversible electric motor and an extendable and retractable bolt for engagement and disengagement with a bolt receptacle in a door jam for a security door. A screw is connected to and rotatably driven by the electric motor, with a nut being threadedly engaged with the screw, the nut having a radially extending locking arm and a radially extending cam follower arm circumferentially spaced from the locking arm, and a cam surface substantially parallel to the screw and along which the cam follower arm is guided from a first position at which the locking arm is engagable with a slot in the bolt, providing a dead-bolt feature, to a second position where the bolt is free to extend or retract. A spring is also provided between the nut and the bolt for biasing the bolt to an extended position when the nut is in the second position.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 6 is a partial rear elevation view of the lock showing the relocking spring held out of a position of interference with the bolt by the cam bracket leg;

FIG. 7 is a partial rear elevation view of the lock with the relocking spring biased to a position of interference with the bolt;

FIG. 8 is a partial sectional view taken in the direction of line 8—8 in FIG. 7;

FIG. 9 is a front sectional view taken in the direction of line 9—9 in FIG. 3;

FIG. 10 is a front sectional view taken in the direction of line 10—10 in FIG. 4; and FIG. 11 is a front sectional view taken in the direction of line 11–11 in FIG. 5.

DETAILED DESCRIPTION OF THE PREFERRED EMBODIMENTS

Figure 1:
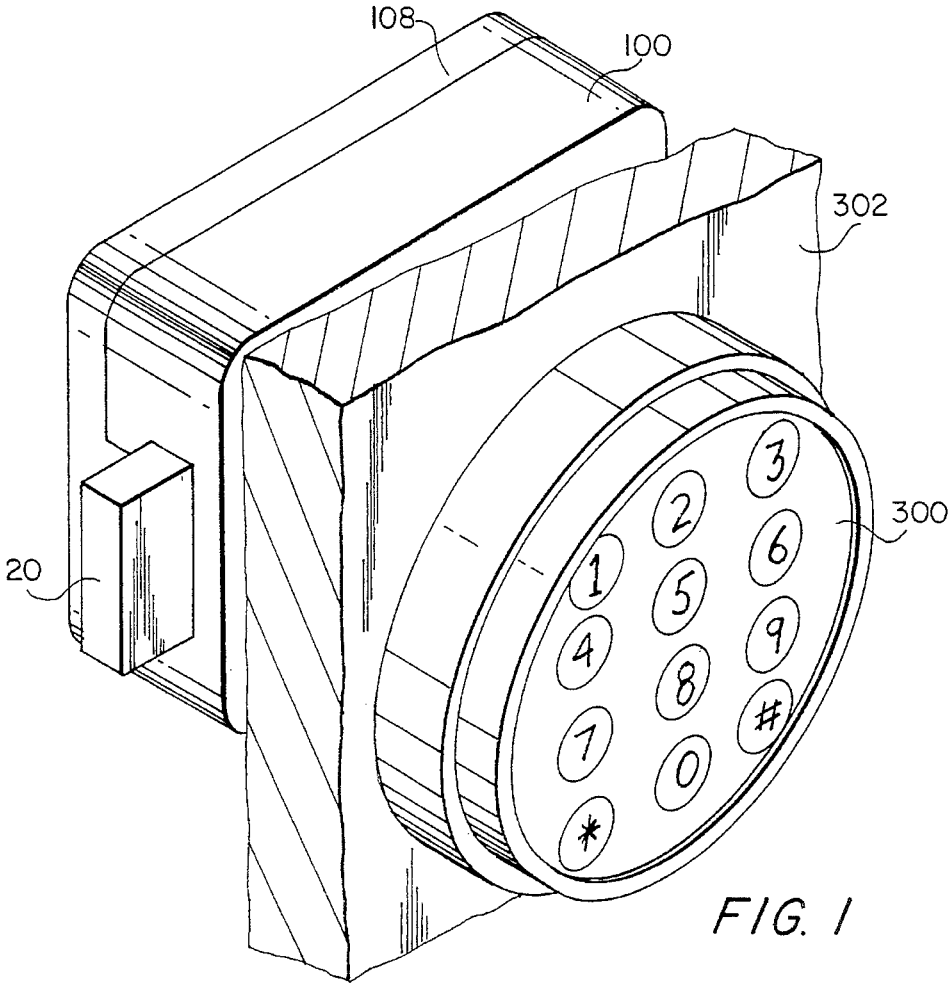
FIG. 1 is a front perspective view of an exemplary safe door having the subject motorized electronic lock on the rear side of the door and an exemplary electronic lock combination push pad for generating a lock opening signal when a predetermined combination of push pad manipulations are accomplished.

Referring initially to FIG. 1, an exemplary safe door 302 is illustrated as having an electronic code input means 300 on the outer front side of the door and a motorized electronic lock provided on the inner rear side of the door.

Figure 3:
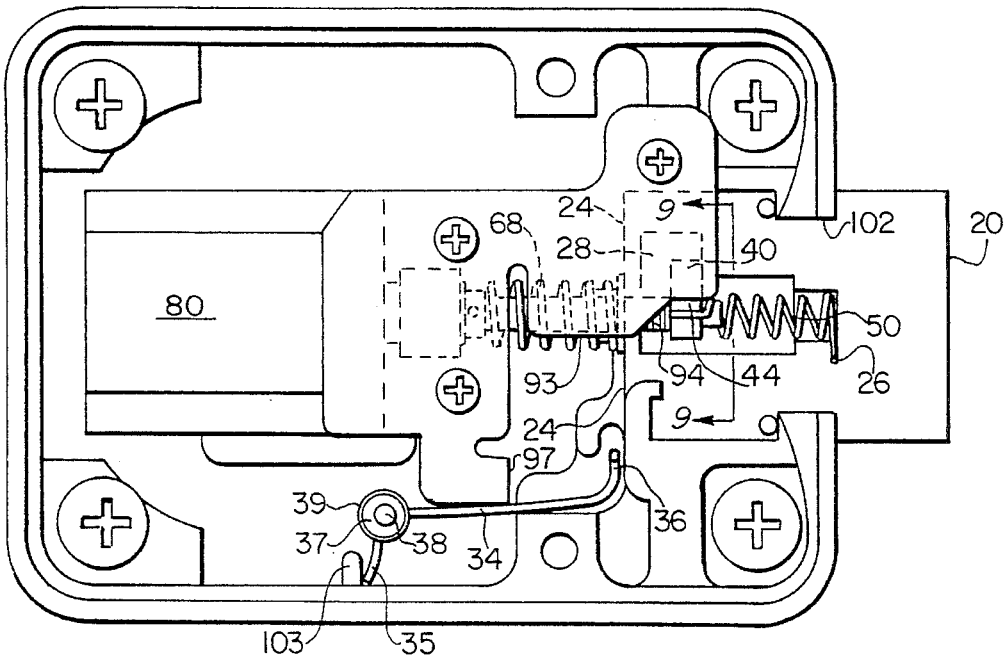
FIG. 3 is a rear elevation view of the lock with the bolt in a fully extended position and the nut in a position to provide a dead bolting function.
Figure 2:
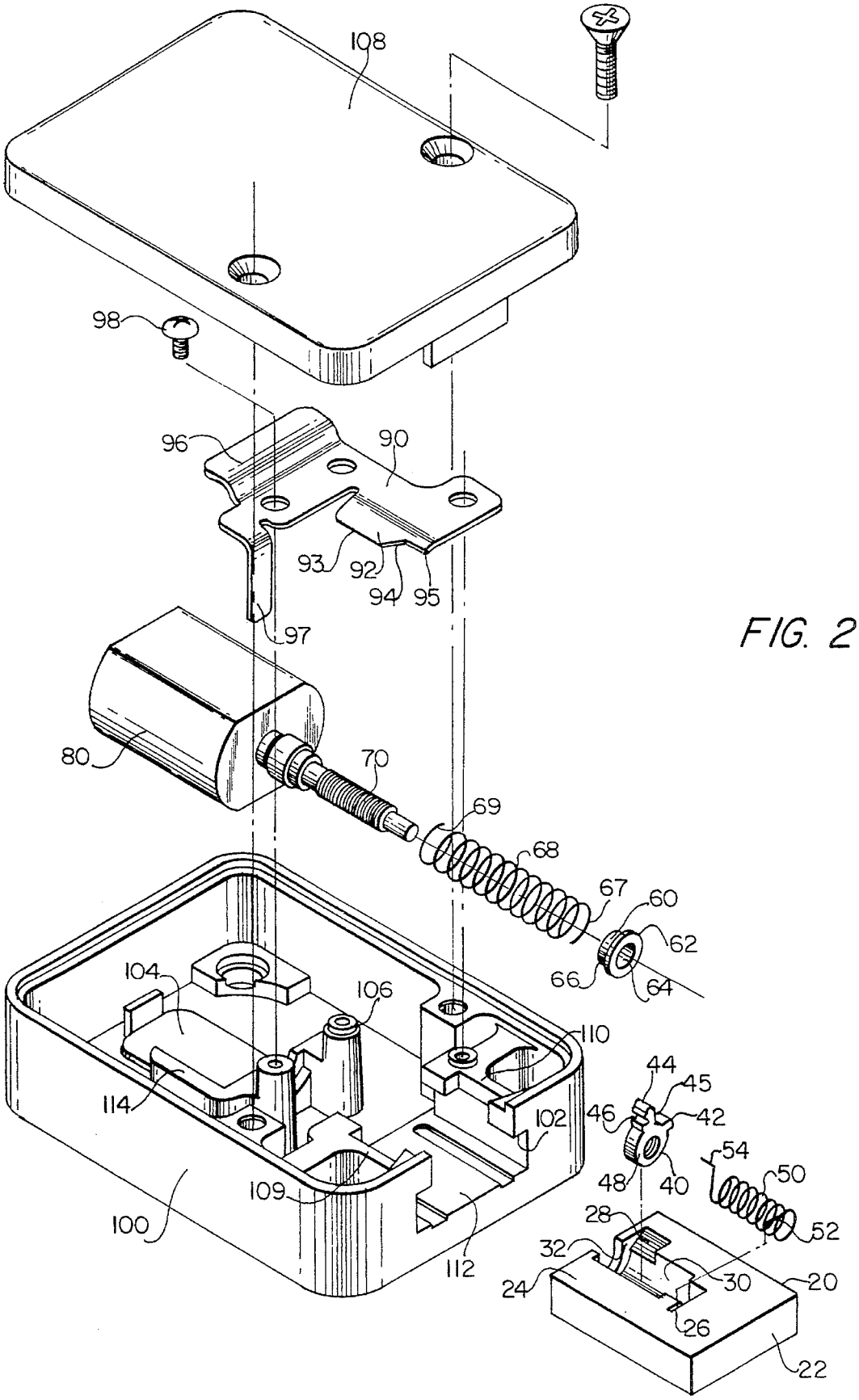
FIG. 2 comprises a detailed exploded view of the preferred embodiment of the motorized electronic lock.

As is particularly contemplated within the present invention, the electronic lock of the present invention is self locking when the safe door is closed and the bolt mechanism is returned to the bolt locking position as illustrated in FIG. 3. In the preferred embodiment, as indicated in FIG. 2, a lock housing 100 is provided and is normally enclosed by a cover plate 108. As shown in FIG. 2, the lock housing 100 is provided with webs 109 and 110, and a reversible electric motor 80 is also provided in the preferred embodiment, and is mounted in the lock housing on a motor boss 104 and held in position by a motor support web 114 and the cam bracket flange 96 of a cam bracket 90 extending partially over top of motor 80.

Cam bracket 90 is attached to lock housing 100 by cam bracket screws 98 which pass through cam bracket 90 into cam boss members 106, which are integral with lock housing 100.

Motor 80 is connected to bolt 20 by a drive screw 70, a nut 40, and a bolt spring 50. Nut 40 is threadedly engaged with screw 70, which is rotatably driven by motor 80. Nut 40 has a radially extending nut locking arm 42 and a radially extending cam follower arm 44 that is circumferentially spaced from nut locking arm 42. A drive screw recess 30 in bolt 20 accepts an end of drive screw 70, as well as nut 40 and a bolt spring 50, which is coaxially positioned over and around screw 70 and is trapped between nut 40 and the outer end of drive screw recess 30.

The outer end of bolt spring 50 is trapped in a laterally extending spring slot 26 at the outer end of drive screw recess 30. The outer or inner end of bolt spring 50 rests against bolt spring guide groove 46 on a surface of cam follower arm 44 that is circumferentially spaced from radially extending locking arm 42.

Bolt spring 50 exerts a clockwise (as viewed in FIG. 2) torsional load or force on nut 40, thereby biasing cam follower surface 43 of cam follower arm 44 against cam lip 92 on cam bracket 90. Bolt spring 50 also provides a compressive load against bolt 20 urging the bolt toward its outer locked position shown in FIG. 3 when nut 40 is moved along drive screw 70 to a point adjacent a leading edge 95 of cam lip 92. When no external means are blocking the leading edge 22 of bolt 20, bolt spring 50 causes bolt 20 to move to its extended locking position of FIG. 3. The foregoing movement of bolt 20 to its locking position permits a cam follower arm 44 to clear cam lip trailing edge 93 of cam bracket 92 and slide along an intermediate edge 94 onto cam lip leading edge 95 of cam bracket 92 to rotate nut 40 clockwise and cause nut locking arm 42 to rotate into a locking arm slot 28 in the upper surface of bolt 20, thereby providing a dead bolting feature, as best shown in FIG. 3.

Bolt 20 is retracted by the operation of motor 80 in a direction to cause nut 40 to move inwardly along drive screw 70 toward motor 80. As nut 40 moves toward motor 80 it eventually contacts bolt shoulder 32 (FIG. 2) and brings bolt 20 along with it so that the bolt is retracted from its extended locking position. As nut 40 begins its inward travel along drive screw 70 toward motor 80, cam follower arm 44 is deflected along cam lip intermediate edge 94 to cam lip trailing edge 93, thereby rotating nut 40 counterclockwise so that locking arm 42 moves out of slot 28 on bolt 20 to terminate the dead bolting function, as best shown in FIGS. 10 and 11.

As bolt 20 is retracted it compresses back spring 68, which is positioned concentrically surrounding drive screw 70 and in between motor 80 and bolt inner edge 24. Back spring 68 is centered on drive screw 70 by spring bushing 60, which has a flange 62 contacting bolt inner edge 24, and a hub portion 66 supporting back spring leading edge 67. The compression of back spring 68 gradually increases the load on motor 80 as the bolt 20 is retracted, thereby slowing down the revolution of motor 80 as bolt 20 approaches its fully retracted position.

Figure 4:
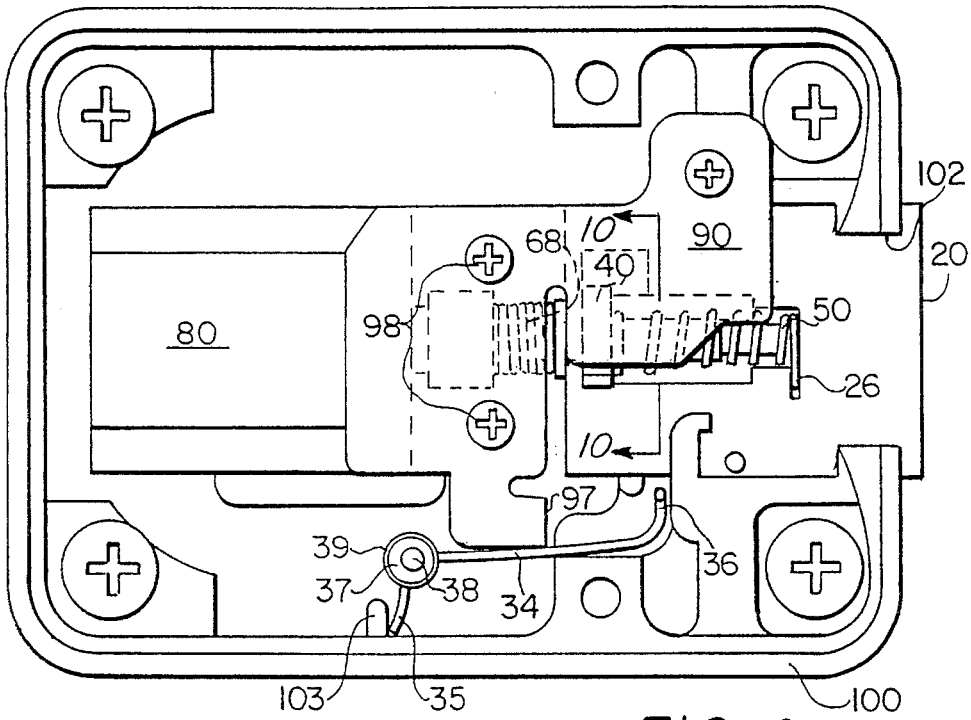
FIG. 4 is a rear elevation view of the lock similar to FIG. 3 but with the nut and the bolt in a fully retracted position.

Operation of motor 80 to cause nut 40 to move along drive screw 70 toward motor 80 is initiated upon entry of a predetermined combination via electronic code input means 300, shown in FIG. 1. Suitable conventional electronic motor control and timing means may be provided, as known in the art, to provide for a first timed period of operation of motor 80 in a first direction of rotation to retract bolt 20 from its extended FIG. 3 position to the retracted unlocked position illustrated in FIG. 4. A second period comprising a timed dwell period while motor 80 remains stationary follows the first timed period of operation. Finally, a third timed period of motor operation occurs wherein motor 80 is reversed and driven in a reverse (extending) direction to return nut 40 to the position shown in FIG. 5. No movement of bolt 20 is required during this third time period if bolt leading edge 22 is blocked by any external means.

Figure 5:
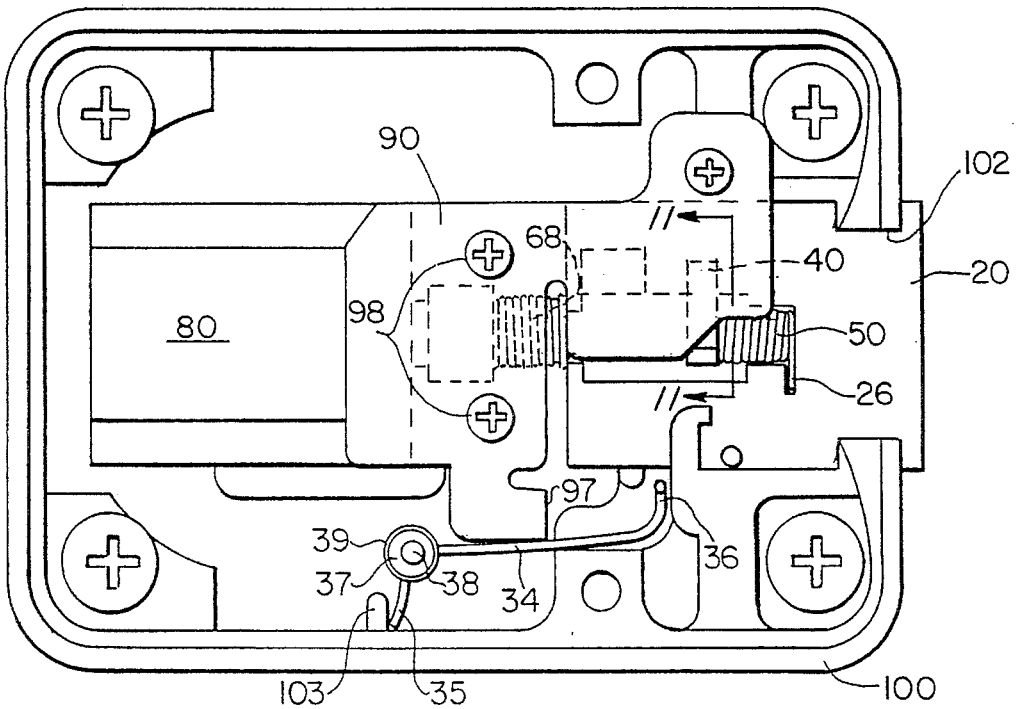
FIG. 5 is a rear elevation view of the lock similar to FIGS. 3 and 4 but with the bolt held in a retracted position by external means (not shown), and the nut in a fully extended position and compressing the bolt spring to provide a biasing force against the bolt.

A "lost motion" connection is consequently provided between motor 80 and bolt 20 since nut 40 can be returned to its fully extended position as shown in FIG. 5 without extending bolt 20. This is so because cam trailing edge 93 prevents locking arm 42 of nut 40 from being rotated into bolt slot 28 by the torsional force from bolt spring 50, as best shown in FIGS. 10 and 11. However, upon reaching the fully extended position shown in FIG. 5, nut 40 will have compressed bolt spring 50 sufficiently against bolt 20 to provide a biasing force urging bolt 20 toward its extended locking position shown in FIG. 3. However, if any obstacles block the bolt from outward movement, it cannot move into the extended locking position until such obstacles are removed from engagement with bolt leading edge 22. Once bolt 20 has moved to its extended position shown in FIG. 3, nut locking arm 42 is biased into slot 28 by bolt spring 50, as shown in FIG. 9. As shown in FIGS. 9, 10, and 11, it is only when nut 40 has traveled along drive screw 70 to a position adjacent cam lip leading edge 95, that nut locking arm 42 is engagable with bolt slot 128, and is capable of providing a dead-bolting feature.

Additionally contemplated within the present invention is a tamper proof feature comprising relocking spring 34 (FIG. 3) which has a leading edge 36 normally biased to a position behind the inner edge 24 of bolt 20. A downwardly extending cam bracket leg 97 normally deflects relocking spring 34 out of the path of bolt 20, as best shown in FIG. 6. Relocking spring 34 is pivotally supported on a spring support post 38 integral with lock housing 100. Relocking spring 34 is held in place on spring support post 38 by relocking spring spacer 39 and spring retaining clip 37. As shown in FIGS. 6 and 7, relocking spring trailing edge 35 contacts relocker boss 103 that is integral with lock housing 100.

If motor 80 is moved upwardly against cam bracket flange 96 with enough force by someone tampering with the lock, cam bracket screws 98 will shear off, allowing cam bracket 90 to raise up and relocking spring 34 to pass underneath the lower end of downwardly extending cam bracket leg 97 and move into a relock position in which spring leading edge 36 faces the inner end 24 of bolt 22 so as to prevent the bolt from moving inwardly from its locked position, as shown in FIGS. 7 and 8.

what is claimed is:

1. A motorized electronic lock comprising:

a lock housing;

a reversible electric motor;

an extendable and retractable bolt for engagement and disengagement with a bolt receptacle in a door jam for a security door, said bolt having an outer leading edge, an inner trailing edge, a surface, and a slot in said surface;

connecting means for transferring a driving force in an axial direction from said electric motor to said bolt, and for preventing retraction of said bolt when said connecting means is in a first position wherein a portion of said connecting means lies within said slot and for allowing retraction of said bolt when said connecting means is rotated about said axial direction from said first position to a second position wherein said portion of said connecting means is removed from said slot;

and cam means for rotating said connecting means between said first and second positions.

2. The motorized electronic lock of claim 1 wherein said connecting means comprises:

a screw connected to and rotatably driven by said electric motor;

a nut threadedly engaged with said screw, said nut having a radially extending locking arm and a radially extending cam follower arm circumferentially spaced from said locking arm; and wherein said cam follower arm is in contact with said cam means.

3. The motorized electronic lock of claim 2 wherein said connecting means includes:

a bolt spring having a central axis;

said bolt spring providing a torsional load against said cam follower arm to bias said cam follower arm against said cam means and to bias said locking arm into said bolt slot when said connecting means is in said first position; and said bolt spring providing a compressive load against said bolt to bias said bolt to an extended position when said connecting means is in said second position.

4. The motorized electronic lock of claim 3, further including:

a back spring provided concentrically surrounding said screw and having a central axis and two axial ends;

a spring bushing provided between one axial end of said back spring and said trailing edge of said bolt; and the back spring central axis being substantially in alignment with said bolt spring central axis.

5. The motorized electronic lock of claim 3, further including:

a relocking spring;

said lock housing having an integral spring support post extending therefrom, said spring support post supporting said relocking spring;

said cam means having a downwardly projecting cam bracket leg and a rearwardly projecting cam bracket flange;

said cam bracket flange projecting over a portion of said motor and holding said motor in position on said lock housing;

said cam bracket leg being movable from a first to a second position upon upward movement of said motor; said cam bracket leg blocking movement of said relocking spring to a normally biased position adjacent said bolt trailing edge when said leg is in said first position and releasing said relocking spring when said leg is in said second position; and said relocking spring moving to said normally biased position and preventing retraction of said bolt when said cam bracket leg is moved to said second position.

6. A motorized electronic lock comprising:

a lock housing;

a bolt having a leading edge, a trailing edge, a surface, and a slot in said surface;

a reversible electric motor;

a screw connected to and rotatably driven by said electric motor;

a nut threadedly engaged with said screw, said nut having a radially extending locking arm and a radially extending cam follower arm circumferentially spaced from said locking arm;

a cam bracket having a horizontally extending cam surface, said cam surface having a recessed portion, and said bracket also having a downwardly projecting leg and a rearwardly projecting flange, said flange projecting over a portion of said motor and holding said motor in position on said housing;

a bolt spring having a central axis and providing a torsional load against said cam follower arm which biases said cam follower arm against said cam surface, and said locking arm entering said slot when said cam follower arm is positioned against said recessed portion of said cam surface, and said bolt spring providing a compressive load against said bolt which biases said bolt to an extended position.

7. The motorized electronic lock of claim 6 further including:

a back spring provided concentrically surrounding said screw and having a central axis and two axial ends;

a spring bushing provided between one axial end of said back spring and said bolt trailing edge; and the back spring central axis being substantially in alignment with said bolt spring central axis.

8. The motorized electronic lock of claim 6, further including:

a relocking spring;

said lock housing having an integral spring support post extending therefrom, said spring support post supporting said relocking spring;

said cam bracket leg movable from a first to a second position upon upward movement of said motor, said cam bracket leg blocking movement of said relocking spring to a normally biased position adjacent said bolt trailing edge when said leg is in said first position and releasing said relocking spring when said leg is in said second position;

and said relocking spring moving to said normally biased position and preventing retraction of said bolt when said cam bracket leg is moved to said second position.

9. The motorized electronic lock of claim 8 further including:

a back spring provided concentrically surrounding said screw and having a central axis and two axial ends;

a spring bushing provided between one axial end of said back spring and said bolt trailing edge; and the back spring central axis being substantially in alignment with said bolt spring central axis.

10. A motorized electronic lock comprising:

a lock housing;

a bolt having a leading edge, a trailing edge, a surface, and a slot in said surface;

a reversible electric motor;

a screw connected to and rotatably driven by said electric motor;

a nut threadedly engaged with said screw, said nut having a radially extending locking arm and a radially extending cam follower arm circumferentially spaced from said locking arm;

a cam bracket having a horizontally extending cam surface, said cam surface having a recessed portion, and said bracket also having a downwardly projecting leg and a rearwardly projecting flange, said flange projecting over a portion of said motor and holding said motor in position on said housing;

a bolt spring having a central axis and providing a torsional load against said cam follower arm which biases said cam follower arm against said cam surface, and said locking arm entering said slot when said cam follower arm is positioned against said recessed portion of said cam surface, and said bolt spring providing a compressive load against said bolt which biases said bolt to an extended position;

a relocking spring;

said lock housing having an integral spring support post extending therefrom, said spring support post supporting said relocking spring;

said cam bracket leg movable from a first to a second position upon upward movement of said motor, said cam bracket leg blocking movement of said relocking spring to a normally biased position adjacent said bolt trailing edge when said leg is in said first position and releasing said relocking spring when said leg is in said second position;

and said relocking spring moving to said normally biased position and preventing retraction of said bolt when said cam bracket leg is moved to said second position.

11. The motorized electronic lock of claim 10 further including:

a back spring provided concentrically surrounding said screw and having a central axis and two axial ends;

a spring bushing provided between one axial end of said back spring and said bolt trailing edge; and the back spring central axis being substantially in alignment with said bolt spring central axis.

* * * * *